United States Patent [19]

Peterson

[11] 4,123,867

[45] Nov. 7, 1978

[54] GAS EXHAUST NIPPLE FOR GUNS

[76] Inventor: Marcus L. Peterson, 2985 Silverview Dr., Cuyahoga Falls, Ohio 44224

[21] Appl. No.: 851,125

[22] Filed: Nov. 14, 1977

[51] Int. Cl.[2] ..... F41C 21/00

[52] U.S. Cl. ..... 42/83

[58] Field of Search ..... 42/83, 51, 69 R

[56] References Cited

U.S. PATENT DOCUMENTS

| | | | |
|---|---|---|---|
| 6,139 | 2/1849 | Minesinger | 42/83 |
| 66,072 | 6/1867 | Blake | 42/69 R |
| 4,065,866 | 1/1978 | Equizabal | 42/51 |

*Primary Examiner*—Charles T. Jordan

*Attorney, Agent, or Firm*—Oldham, Oldham, Hudak & Weber Co.

[57] ABSTRACT

An insert sleeve for use in the firing system of a muzzle loading gun wherein the insert sleeve has a bore operably connecting the atmosphere to the bore of the gun barrel and having a conventional firing member operatively associated with the outer end of such insert sleeve. A nipple formed from a heat resisting metal is positioned in the sleeve at the inner end thereof and has a smaller diameter center portion than any other portion of the bore of the sleeve to form the limiting size connector opening from the firing means to the muzzle loader bore of the gun barrel.

6 Claims, 5 Drawing Figures

GAS EXHAUST NIPPLE FOR GUNS

BACKGROUND OF THE INVENTION

Man has always had great interest in guns and has used them for many years. Individual ownership of guns is widespread. One special type of gun that has had appreciable interest in it recently has been the old style muzzle loader guns that were the best weapons available many years ago when our country was being settled. These muzzle loader guns are currently used in various marksmanship tournaments and naturally it is very desirable that the guns be accurate, safe and be reliable in use.

Some parts in muzzle loader guns have not been satisfactorily resistant to the heat and pressure conditions produced by repeated use of the guns. Hence, many of the guns used in tournaments do not retain their initial accuracy after extended periods of use as a gradual loss of accuracy occurs due apparently to slight changes in the operating pressures and conditions in the guns.

These muzzle loaders have, as a special portion thereof, an ignition orifice or port formed in the gun barrel wherein the ignition spark or flame is transmitted from a point external of the gun bore to a location internally of the gun bore. The muzzle loaders have one closed end of the bore adjacent the shoulder stock on the gun and the ignition mechanism and firing trigger are operatively positioned on the gun stock and connect to the ignition means to set up the ignition spark and flame for firing the gun. Such ignition opening is subject to a sudden rush of hot explosive gases rapidly flowing to or out of the ignition port with simultaneous expulsion of the bullet from the gun muzzle or bore. These ignition blasts and rushes of hot gases to the ignition bore have tended to cause rapid wear in the ignition port or orifice and its size and effective diameter has been found to vary appreciably with use. This change in ignition bore conditions is believed to effect the accuracy and firing conditions of the gun.

It is the general object of the present invention to provide an improved accuracy muzzle loader gun and specifically to provide an insert sleeve for use in muzzle loader guns wherein such insert sleeve has improved wear properties.

A further object of the invention is to provide a heat resistant nipple in an insert sleeve in a muzzle loader gun to form the confining bore or sleeve means for establishing the effective diameter of the ignition port or orifice for ignition and gas escape purposes.

Another object of the invention is to use an improved corrosion and heat resistant metal, such as platinum, in a special insert nipple in a sleeve used in muzzle loader guns for forming part of the ignition path therein.

The foregoing and other objects and advantages of the invention will be made more apparent as the specification proceeds.

Attention now is particularly drawn to the accompanying drawings, wherein.

When referring to corresponding members shown in the drawings and referred to in the specification, corresponding numerals are used to facilitate comparison therebetween.

SUBJECT MATTER OF INVENTION

This invention relates to the combination, with a muzzle loading gun having a barrel, a stock, and trigger and firing means, with an insert sleeve operatively connecting the atmosphere to the bore of the gun barrel, and a nipple positioned in the sleeve at the inner end thereof and retained against axially outward movement by abutting on a shoulder in the sleeve, which nipple has a smaller diameter center bore than any portion of the bore of the sleeve to form the limiting passageway connecting the firing device with the gun barrel bore.

Figure 4:
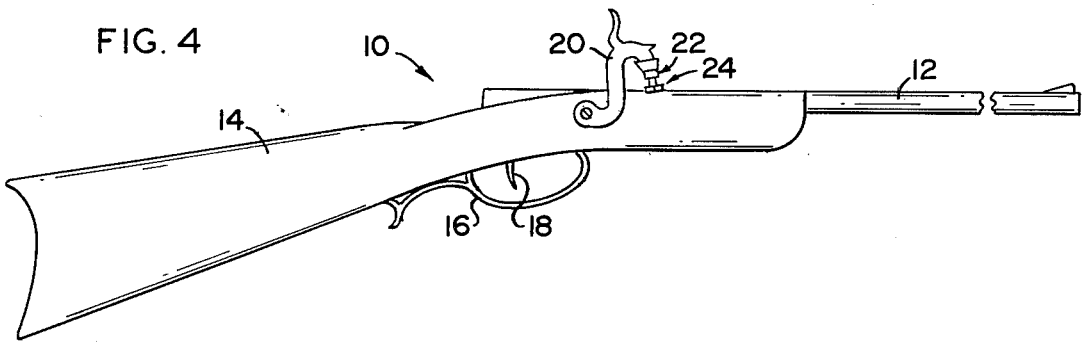
FIG. 4 is a side elevation of a typical muzzle loader gun.

Reference now is particularly directed to the accompanying drawings wherein a muzzle loading gun is indicated as a whole in FIG. 4 by the numeral 10. This gun 10 includes a barrel 12 and a gun stock 14. The gun barrel 12 is suitably mounted on the stock 14 in any conventional manner, and a trigger guard assembly 16 is secured to the gun stock and a conventional trigger means 18 is positioned therein. The gun 10 also includes a firing means or percussion hammer 20 that is pivotally secured to the gun stock in a conventional manner and is operated by the trigger 18 by conventional means. This hammer 20 is adapted to strike against a percussion cap 22 or similar firing means that is positioned on the outer end of an insert sleeve indicated as a whole by the numeral 24.

Figure 1:
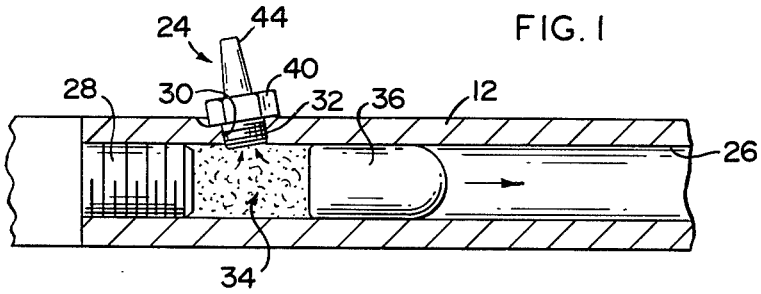
FIG. 1 is a fragmentary view, mostly shown in horizontal section, of a segment of a muzzle loader gun indicating the load chamber and part of the associated firing means.
Figure 2:
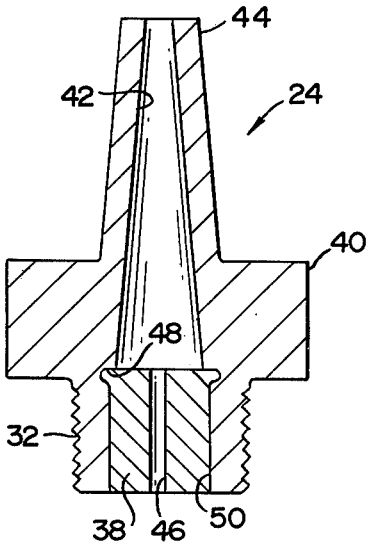
FIG. 2 is an enlarged vertical section through an insert sleeve embodying the principles of the invention.
Figure 3:
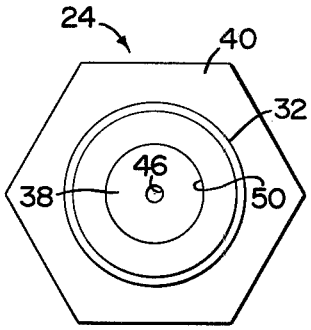
FIG. 3 is an end elevation of the insert sleeve of FIG. 2.
Figure 5:
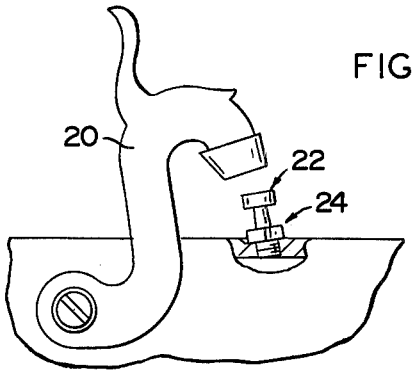
FIG. 5 is a fragmentary diagrammatic sketch showing the insert sleeve's operative position in a gun.

The gun barrel 12 as shown in more detail in FIG. 1, has a bore 26 therein and it is closed at its inner end in a conventional manner as by a plug 28. The wall of the gun barrel 12 has an opening or orifice 30 provided therein and in this instance, the inner end of the insert sleeve 24 is threaded as at 32 to secure the insert sleeve to the gun barrel with the bore of the insert sleeve connecting the atmosphere with the bore of the gun barrel for transmitting a firing spark or flame to a black powder mass 34 packed into the bore of the gun barrel as by a bullet 36. Such bullet or ball obviously is propelled from the free end of the gun barrel when the black powder 34 burns.

Black powder notoriously is a very corrosive material and these guns 10 do tend to corrode rapidly and it is difficult to maintain the accuracy thereof. Hence, a feature of the present invention is to aid in maintaining uniform firing conditions. To aid in such action, the insert sleeve 32 has a nipple 38 suitably engaged with the inner end of the insert sleeve. The insert sleeve 32 normally has a shoulder 40 thereon which may abut against the gun barrel or gun stock for limiting engagement action of the nipple with the gun barrel. It will be seen that the bore 42 of the insert sleeve converges toward its exposed, or outer, end 44.

The limiting member for flow of firing sparks or flame through the insert sleeve 32 is the diameter of bore 46 of this insert sleeve. Such bore is normally only of a few hundredths of an inch in diameter, but by making the insert nipple from a heat and wear resistant material, such as platinum, this bore will remain substantially constant and uniform in size even over extended periods of use of the gun.

The nipple 38 is retained in place preferably by abutting the inner end of the nipple against a shoulder 48 formed by a counterbore 50 in the insert sleeve 32. This construction also aids in permanently holding the nipple in position. The nipple can be merely in force fit engagement with the bore of the insert sleeve, or it can be press fitted therein in any suitable way even to having a force fit at its inner end against the shoulder by providing an undercut in the bore wall at such shoulder. Hence, when the black powder explodes in the gun barrel, all forces exerted on the nipple 38 are really applied to the inner end of the nipple to seat it against the shoulder 48 more tightly and, hence, the nipple will remain in place for a good operative life.

Use of the nipple and insert sleeve combination of the invention is adapted to be made with substantially any conventional type of a muzzle loader gun as long as any type of a removable sleeve is provided for connecting the external firing means on the muzzle loader to the gun barrel compression zone to connect to the black powder compressed therein.

The insert sleeve 24 can be positioned in any usual engagement with the gun barrel and bore. The firing means, trigger controls and gun stock, etc., are all conventional. FIGS. 1 and 4 may be the same or different guns.

Hence, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. In a muzzle loading gun having a barrel with a firing or ignition orifice formed therein, the gun barrel having a bore with an inner end and having said orifice extending from the bore through the barrel wall adjacent the inner end of said bore, an insert sleeve operatively engaging said orifice, and a nipple in said sleeve and having a smaller diameter center bore than any portion of the bore of said sleeve, said nipple being made from a heat resisting metal.

2. In a muzzle loading gun as in claim 1, said nipple being made from platinum.

3. In a muzzle loading gun as in claim 1, where a hammer member is provided for striking a firing means positioned on the outer end of said insert sleeve, and a conventional trigger means engages and controls said hammer member.

4. In a muzzle loading gun as in claim 1, said insert sleeve having inner and outer ends, and a counterbore at its inner end, and said nipple being in operative engagement with said counterbore.

5. An insert sleeve for providing a firing path for muzzle loader guns and comprising a sleeve having a threaded periphery at one end and a counterbore at its threaded end, and a nipple in operative engagement with said counterbore and abutting on a shoulder formed at the end of said counterbore, said nipple being formed of platinum and maintaining a uniform diameter bore for a good service life after repeated firings of any gun with which the insert sleeve is used.

6. An insert sleeve as in claim 5, where said nipple is made from a corrosion and heat resistant material, said nipple having a bore smaller in diameter than the bore of said sleeve.

* * * * *